US007071961B2

(12) United States Patent
Ullenius et al.

(10) Patent No.: US 7,071,961 B2
(45) Date of Patent: Jul. 4, 2006

(54) RIBBON DRIVE AND TENSIONING SYSTEM FOR A PRINT AND APPLY ENGINE FOR A PRINTER

(75) Inventors: Kenneth Folke Ullenius, Kingsford, MI (US); Robert A. Ehrhardt, Jr., Palatine, IL (US); Dale William Skamra, Gurnee, IL (US)

(73) Assignee: ZIH Corp., Wilmington, DE (US)

( * ) Notice: Subject to any disclaimer, the term of this patent is extended or adjusted under 35 U.S.C. 154(b) by 0 days.

(21) Appl. No.: 11/023,001

(22) Filed: Dec. 27, 2004

(65) Prior Publication Data

US 2005/0105950 A1 May 19, 2005

Related U.S. Application Data

(63) Continuation of application No. 10/086,035, filed on Feb. 28, 2002.

(60) Provisional application No. 60/285,671, filed on Apr. 23, 2001.

(51) Int. Cl.
*B41J 2/325* (2006.01)

(52) U.S. Cl. ..... 347/219

(58) Field of Classification Search ..... 347/219, 347/172, 174–178, 212, 217; 400/120.02, 400/120.03, 120.04, 120.18, 225, 618; 360/93
See application file for complete search history.

(56) References Cited

U.S. PATENT DOCUMENTS

| | | | | |
|---|---|---|---|---|
| 3,759,456 | A | | 9/1973 | Moneagle et al. |
| 3,889,893 | A | | 6/1975 | Silverman et al. |
| 4,277,034 | A | | 7/1981 | Buzzell |
| 4,356,765 | A | | 11/1982 | Houseman et al. |
| 4,657,164 | A | | 4/1987 | Felix |
| 4,860,025 | A | * | 8/1989 | Berson et al. ..... 347/217 |
| 4,923,133 | A | | 5/1990 | Zaman et al. |
| 4,939,715 | A | * | 7/1990 | Vogelgesang et al. ..... 360/93 |
| 5,374,007 | A | | 12/1994 | Murison |
| 5,409,441 | A | | 4/1995 | Muscoplat |
| 5,433,539 | A | * | 7/1995 | German ..... 400/225 |
| 5,468,080 | A | * | 11/1995 | Jones ..... 400/618 |
| 5,743,663 | A | * | 4/1998 | Imai ..... 400/120.04 |
| 5,748,204 | A | | 5/1998 | Harrison |
| 5,779,830 | A | | 7/1998 | Wakefield et al. |
| 5,794,869 | A | | 8/1998 | Takano et al. |
| 5,808,654 | A | | 9/1998 | Loos |
| 5,825,374 | A | | 10/1998 | Albertalli et al. |
| 5,857,786 | A | | 1/1999 | Randolph |
| 5,873,662 | A | | 2/1999 | Clevinger |
| 5,911,383 | A | | 6/1999 | Jacobsen et al. |
| 6,000,595 | A | | 12/1999 | Crowley et al. |

(Continued)

FOREIGN PATENT DOCUMENTS

EP 0672529 9/1995

*Primary Examiner*—K. Feggins
(74) *Attorney, Agent, or Firm*—Alston & Bird LLP

(57) ABSTRACT

An apparatus for driving and tensioning a ribbon includes a supply spindle for supplying a ribbon, a supply dancer assembly for applying tension to the ribbon, a printhead, a take-up dancer assembly for applying tension to the ribbon, and a take-up spindle for collecting spent ribbon. The supply dancer assembly is positioned downstream of the supply spindle. The printhead is positioned downstream of the supply dancer assembly. The take-up dancer assembly is downstream of the printhead. The take-up spindle is downstream of the take-up dancer assembly.

31 Claims, 7 Drawing Sheets

U.S. PATENT DOCUMENTS 6,082,914 A 7/2000 Barrus et al.
6,095,704 A 8/2000 Jaeger et al.
6,201,255 B1 3/2001 Torchalski et al.
6,313,861 B1 11/2001 Schartner

* cited by examiner

RIBBON DRIVE AND TENSIONING SYSTEM FOR A PRINT AND APPLY ENGINE FOR A PRINTER

RELATED APPLICATION(S)

This application is a continuation application of U.S. patent application Ser. No. 10/086,035, filed on Feb. 28, 2002 (now allowed). U.S. patent application Ser. No. 10/086,035 claims priority from U.S. provisional application Ser. No. 60/285,671, filed on Apr. 23, 2001.

FIELD AND BACKGROUND OF THE INVENTION

A novel ribbon drive and tensioning system is provided for a print and apply engine, a thermal printer or any other printer which utilizes a ribbon having a medium thereon which can be transferred, such as ink, wax, a polymer material, dye, etc., onto a label. The present system significantly increases label throughput without sacrificing registration of the printed image on the label. To accomplish this, faster acceleration and deceleration ramps, a ramp being defined as a graph of velocity versus time, are provided. To enable faster ramps, while not affecting image registration on the label, the inertial ribbon tension variances associated with starting and stopping the rotation of the supply and take-up ribbon rolls in the ribbon system were decreased and the ribbon tension changes that occur as the ribbon roll diameter changes were minimized. This improves image registration and controls "smudging: or "scuffing" of the printed image on the label.

The present ribbon drive and tensioning system maintains uniform ribbon tension as the ribbon roll diameter varies as ribbon unwinds from the ribbon supply spindle and rewinds on the ribbon take-up spindle and enables faster acceleration/deceleration ramps by minimizing the inertial effects of the ribbon rolls and their spindles through the use of positional servo-controlled dancing arms. The present system also enables operation with longer length/larger diameter (higher inertia) ribbon rolls, thereby requiring fewer ribbon changeovers.

In prior art systems, the platen roller drives the media which, in turn, drives the ribbon through friction. Differential ribbon tension across the platen roller causes micro-slippage that adversely affects image registration on the label. Large instantaneous ribbon tension changes, like those associated with acceleration and deceleration ramps and the high inertia of the ribbon spindles, can cause image registration errors. In some situations, slack ribbon loops can occur which create ribbon tension spikes that can cause smudge or scuff marks on the label due to high ribbon slip rates if the slack is rapidly taken up. Prior art thermal printers and print and apply printers typically use slip clutches or torque motors to maintain ribbon tension. In these systems, the input/output ribbon tension varies with the changing diameters of the supply and take-up ribbon rolls. In some prior art printers, DC torque motors vary torque proportional to the ribbon roll diameter to maintain more uniform ribbon tension, however, the corrections are not ideal. Tension changes with different diameters still exist. In addition, the DC torque motors add inertia which increases inertial tension variance.

The present system uses positional (tension) servo-controlled dancing arms at both the ribbon supply and the ribbon take-up spindles to control the ribbon tension, thereby isolating the causes for tension errors present in prior art thermal printers. The low inertia dancing arms of the present invention absorb ribbon impulses during acceleration/deceleration ramps. There are no tension changes caused by the high inertia ribbon spindles and their DC drive motors because of the isolation provided by the dancing arms. Because the dancing arms create the ribbon tension, there is no tension change as the ribbon roll size changes.

OBJECTS AND SUMMARY OF THE INVENTION

A general object of the invention is to provide a novel ribbon drive and tensioning system for a print and apply engine, a thermal printer or any other printer which utilizes a ribbon having a medium thereon which can be transferred, such as ink, wax, a polymer material, dye, etc., onto a label.

Another general object of the invention is to provide a novel ribbon drive and tensioning system for a print and apply engine, a thermal printer or any other printer that is capable of maintaining uniform ribbon tensions when operating with high acceleration/deceleration ramps and long ribbon lengths/ribbon diameters.

Briefly, and in accordance with the foregoing, a novel ribbon drive and tensioning system is provided for a print and apply engine, a thermal printer or any other printer which utilizes a ribbon having a medium thereon which can be transferred, such as ink, wax, a polymer material, dye, etc., onto a label. The ribbon drive and tensioning system uses positional servo-controlled dancing arms with low inertia to control ribbon tension. A supply assembly includes a dancer assembly that contains a dancing arm subassembly and a loop cavity subassembly, a position sensor that measures dancing arm position, a spindle to hold the unused ribbon, a torque motor that drives the spindle through applicable gearing, an amplifier that drives the torque motor, electronics that convert the sensor output to a signal that is compatible with the amplifier and a plurality of rollers that guide and control the ribbon. A take-up assembly includes a dancer assembly that contains a dancing arm subassembly and a loop cavity subassembly, a position sensor that measures dancing arm position, a spindle to hold the used ribbon, a torque motor that drives the spindle through applicable gearing, an amplifier that drives torque motor, electronics that convert the sensor output to a signal that is compatible with the amplifier and a plurality of rollers that guide and control the ribbon.

BRIEF DESCRIPTION OF THE DRAWINGS

The organization and manner of the structure and operation of the invention, together with further objects and advantages thereof, may best be understood by reference to the following description, taken in connection with the accompanying drawings, wherein like reference numerals identify like elements in which.

DETAILED DESCRIPTION OF THE ILLUSTRATED EMBODIMENT(S)

Figure 1:
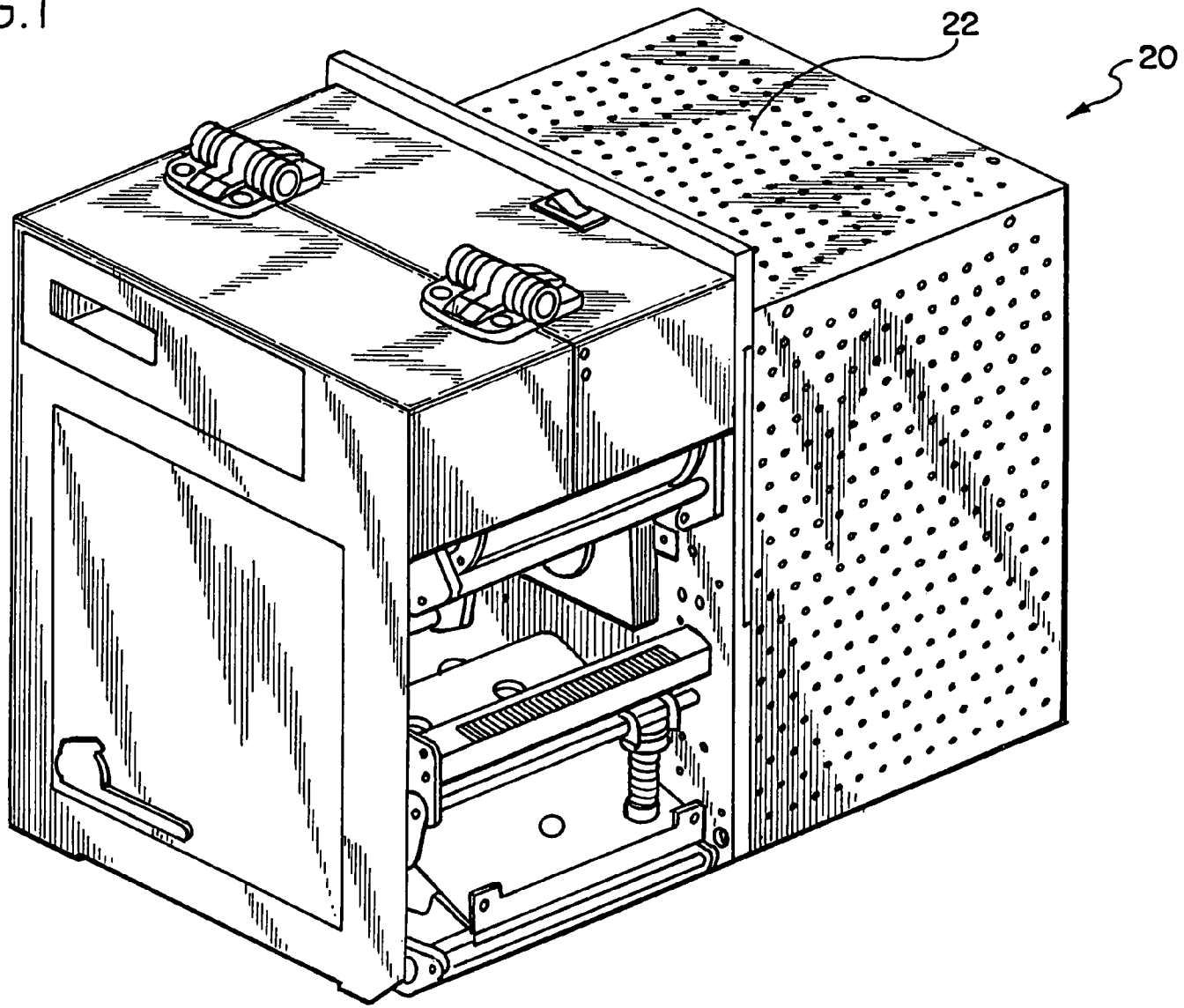
FIGS. 1 and 2 are perspective views of a print and apply engine.

While the invention may be susceptible to embodiment in different forms, there is shown in the drawings, and herein will be described in detail, specific embodiments with the understanding that the present disclosure is to be considered an exemplification of the principles of the invention, and is not intended to limit the invention to that as illustrated and described herein.

Figure 2:
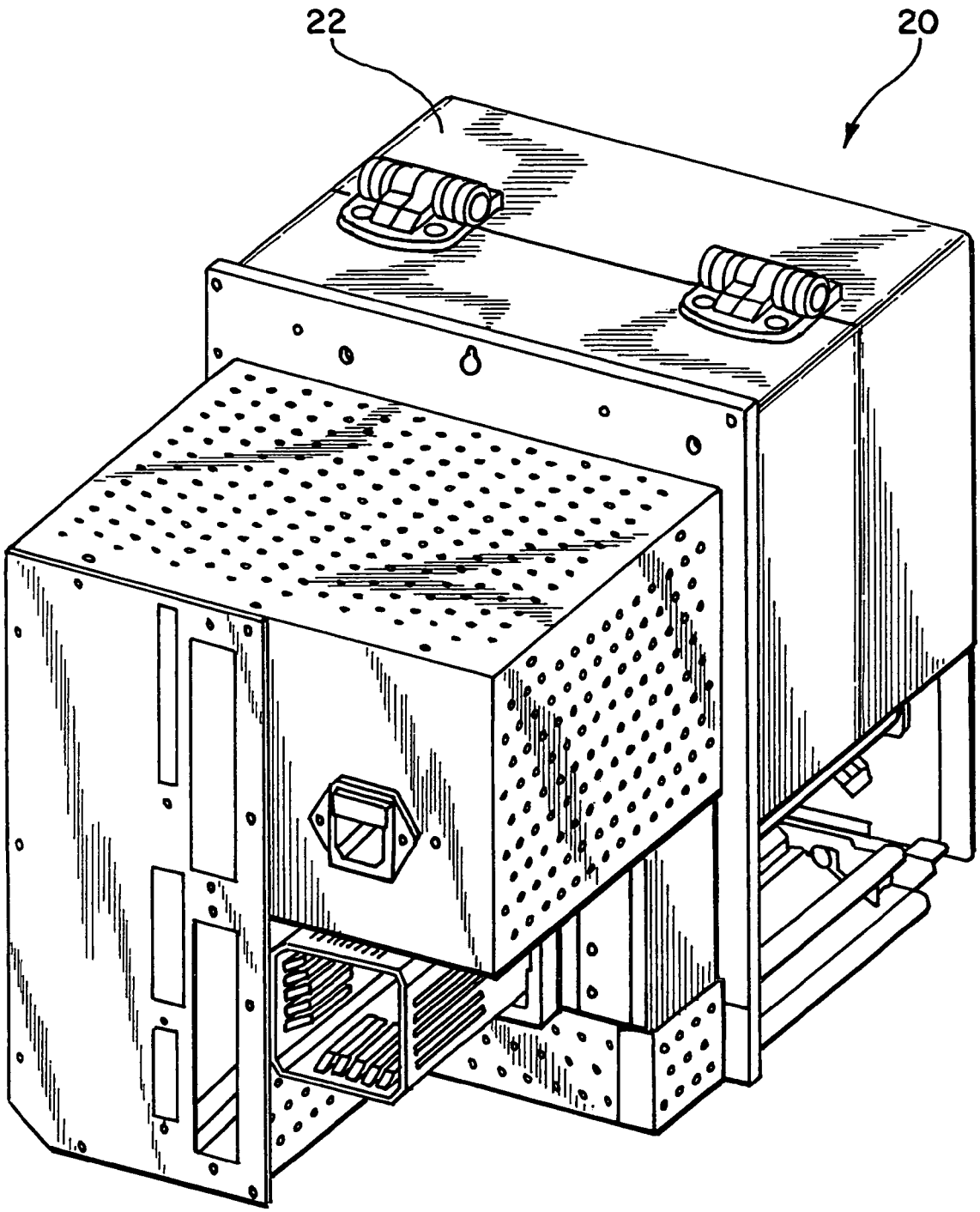
Figure 3:
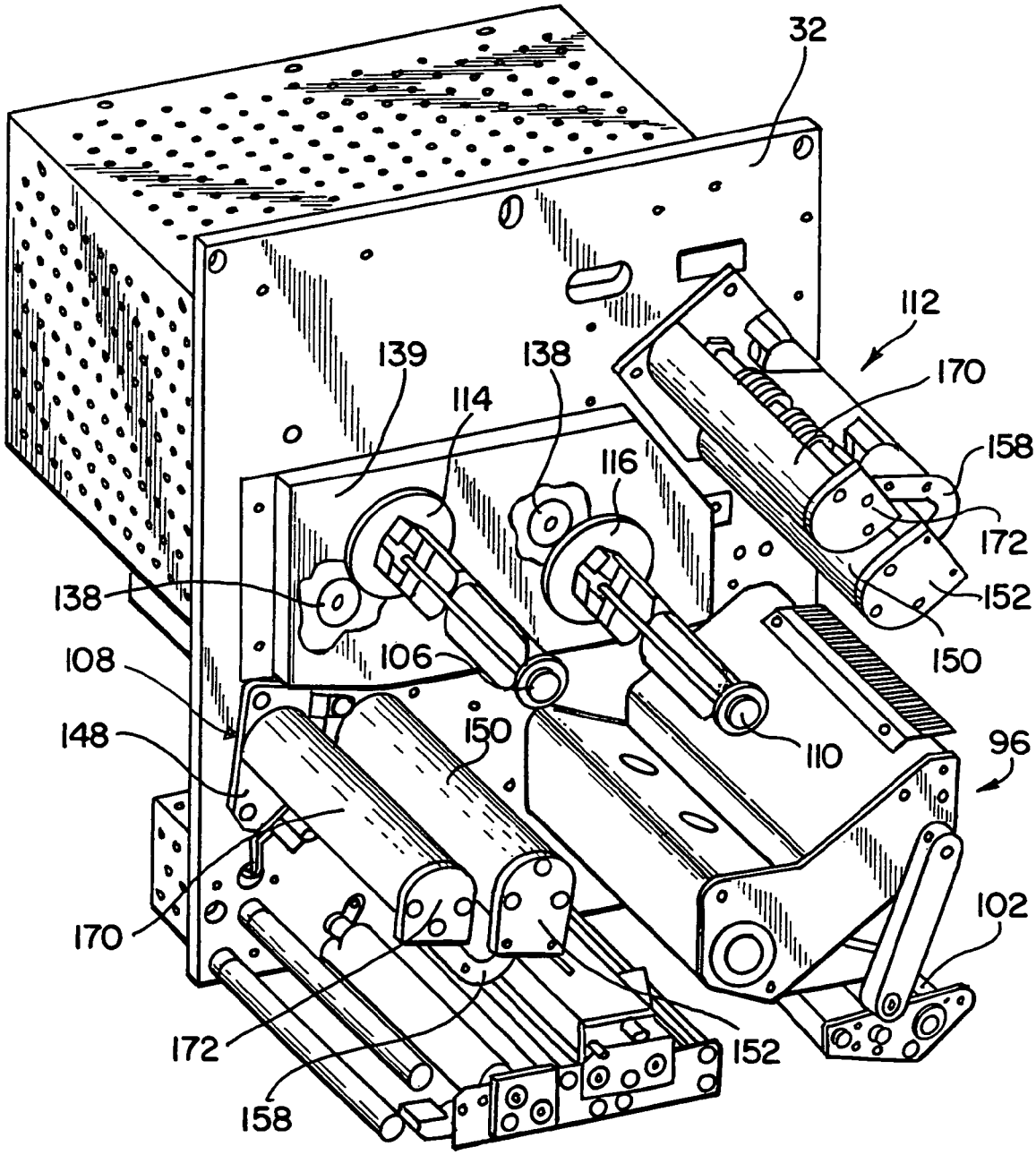
FIG. 3 is a perspective view of the media side of the print and apply engine.

Perspective views of a print and apply engine 20 are shown in FIGS. 1 and 2. The print and apply engine 20 has a housing 22 which houses various operating components. As shown in FIG. 2, the housing 22 has a plurality of ports, serial and/or parallel, thereon for connection to external devices, such as a CPU and a monitor, a plug for connection of a power source thereto, and an on/off switch for turning the print and apply engine 20 on or off. Ventilation apertures are provided on the housing 22. A central support wall 32, shown in FIG. 3, is provided within the housing 22 and extends perpendicularly from a bottom wall of the housing 22 and is secured thereto. While the ribbon drive and tensioning system is described with respect to the print and apply engine 20, the invention can be used on a thermal printer or any other printer which utilizes a ribbon having a medium thereon which can be transferred, such as ink, wax, a polymer material, dye, etc., onto a label.

FIG. 3 shows the internal components of the print and apply engine 20 on one side of the central support wall 32. The electronics are provided on the other side of the central support wall 32.

A conventional printhead assembly 96 is provided and includes a conventional printhead support and conventional printhead means fixedly attached thereto. The printhead means is comprised of an array of heating elements which are selectively energized. Energizing selected heating elements of the array produces a single line of a printed image by heating a thermally sensitive paper, ribbon, or some other media (not shown). While ribbon is described herein, it is to be understood that these other types of media are suitable, along with other types of media known in the art. Complete images are printed by repeatedly energizing varying patterns of the heating elements while moving media past the printhead means. Power to the printhead means is supplied by a power source which is wired thereto by a cable which passes from the power supply through the central support wall 32.

Media delivery means is provided for delivering media (not shown) to the printhead means. The media delivery means includes a conventional positively-driven platen roller 102. The media is fed into the print and apply engine 20 from an outside source. The media may be comprised of a backing (also known as a liner or web) having a plurality of labels releasably secured thereto. The labels are releasably secured to the backing by a releasable adhesive. The labels are spaced apart from each other on the backing.

The platen roller 102 is cylindrical and extends perpendicularly outwardly from the central support wall 32 and is rotatably mounted thereto. The platen roller 102 has a shaft that extends through the central support wall 32 and connects with a driving system (not shown).

Ribbon delivery means are provided for delivering the ribbon to the printhead means. The ribbon delivery means generally includes a ribbon supply spindle 106, a supply dancer assembly 108, a ribbon take-up spindle 110, and a take-up dancer assembly 112. The ribbon is a thermally activated ribbon which transfers ink onto the media when the printhead means is thermally activated by suitable electronics.

The ribbon supply spindle 106 is cantilevered from the central support wall 32 such that the ribbon supply spindle 106 extends outwardly and perpendicularly therefrom. A gear 114 is provided at end of the ribbon supply spindle 106 and affixed thereto. The gear 114 is proximate to the central support wall 32. The ribbon supply spindle 106 and gear 114 are rotatable relative to the central support wall 32.

The ribbon take-up spindle 110 is cantilevered from the central support wall 32 such that the ribbon take-up spindle 110 extends outwardly and perpendicularly therefrom. A gear 116 is provided at end of the ribbon take-up spindle 110 and affixed thereto. The gear 116 is proximate to the central support wall 32. The ribbon take-up spindle 110 and gear 116 are rotatable relative to the central support wall 32. The ribbon take-up spindle 110 is spaced apart from the ribbon supply spindle 106 on the central support wall 32.

Figure 4:
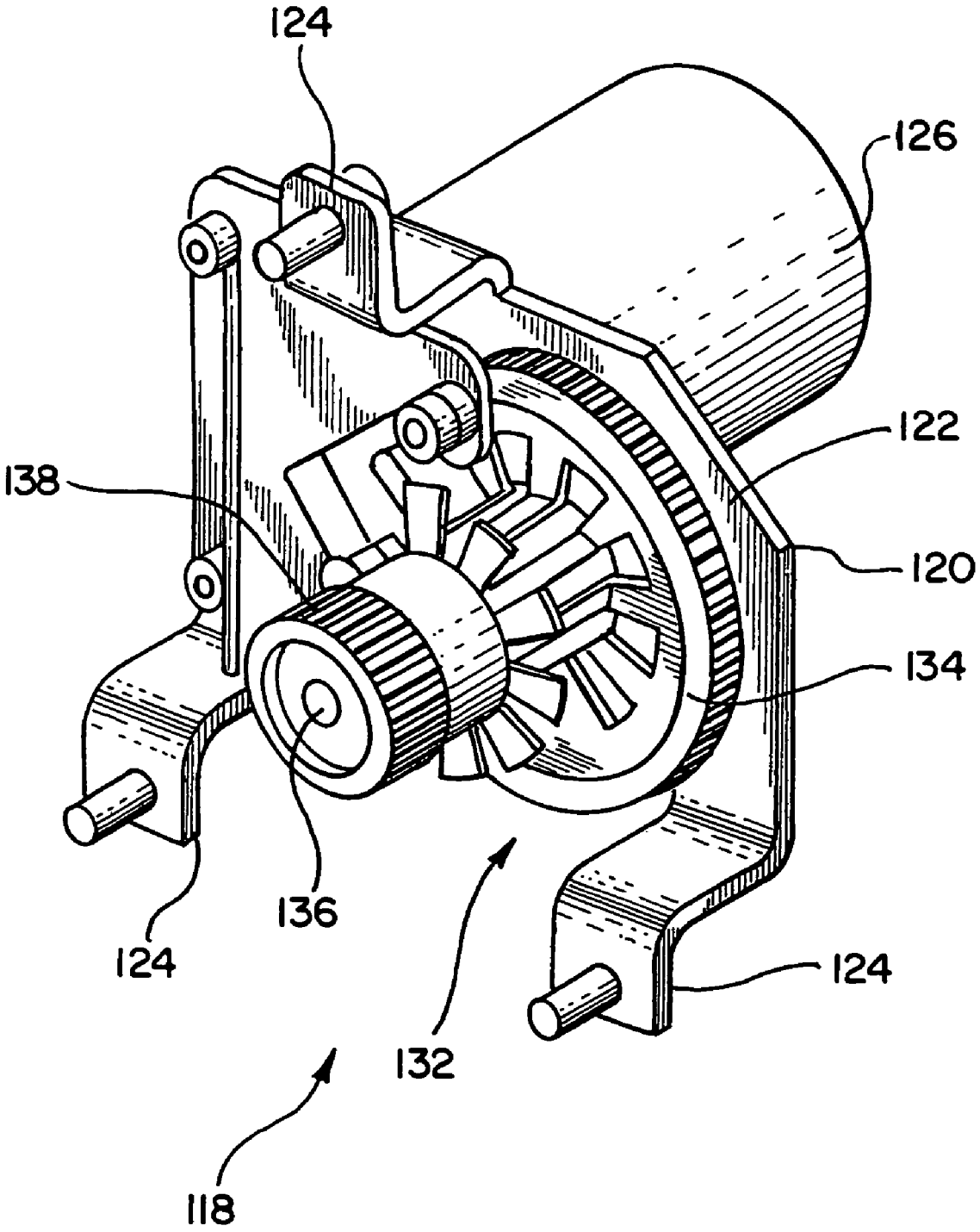
FIG. 4 is a perspective view of a ribbon drive assembly.

A ribbon drive assembly 118 is shown in FIG. 4. One ribbon drive assembly is used to drive the ribbon supply spindle 106. Another identical ribbon drive assembly is used to drive the ribbon take-up spindle 110. Ribbon drive assembly 118 which drives the ribbon supply spindle 106 is described with the understanding that the ribbon drive assembly which drives the ribbon take-up spindle 110 is identical in construction.

A mounting plate 120 is mounted to the opposite side of the central support wall 32 to which the ribbon supply spindle 106, the supply dancer assembly 108, the ribbon take-up spindle 110, and the take-up dancer assembly 112 are mounted. The mounting plate 120 includes a flat base 122 which is parallel to the central support wall 32 and a plurality of legs 124 which depend from the base 122. The legs 124 are attached to the central support wall 32 by suitable means, such as screws, and serve to space the base 122 away from the central support wall 32. The mounting plate 122 is made of a suitable strong material, such as sheet metal.

A DC torque motor 126 is attached to the side of the base 122 which is opposite to the legs 124. The DC torque motor 126 has a shaft which extends therefrom and which extends through the base 122. A pinion gear (not shown) is mounted on the free end of the shaft and on the opposite side of the base 122 from the DC torque motor 126.

A shaft 136 is rigidly cantilever attached to perpendicular to the mounting plate 120. A two stage intermediate gear 132 is located by and rotates on the shaft 136. The two stage intermediate gear 132 includes a larger diameter gear 134 and a smaller diameter gear 138. The larger diameter gear 134 and the smaller diameter gear 138 are integral and rotate as one. A flat thrust washer (not shown) and a retaining ring (not shown) secure the intermediate gear 132 to the shaft 136 so that the intermediate gear 132 is free to rotate on the shaft 136, but cannot move axially on the shaft 136. The teeth on the larger diameter gear 134 intermesh with the teeth on the DC torque motor pinion gear.

The smaller diameter gear 138 extends through an aperture in the central support wall 32. The teeth on the smaller diameter gear 138 intermesh with the teeth on the supply gear 114, see FIG. 3. The supply gear 114 and the spindle 106 extend through a cover 139. The cover 139 has been broken away to show smaller diameter gear 138 which is mounted between the central support wall 32 and the cover 139. As discussed, a similar ribbon drive assembly is used to drive the ribbon take-up spindle 110. The smaller diameter gear 138 in this ribbon drive assembly is shown in FIG. 3 intermesh with the teeth on the take-up gear 116. The gear ratio between the DC torque motors 126 (one each for the ribbon supply spindle 106 and the ribbon take-up spindle 110) and the respective spindles 106, 110 is approximately 16 to 1.

As shown in FIG. 3, the supply dancer assembly 108 and the take-up dancer assembly 112 are identical in construction. As shown in FIG. 3, the supply dancer assembly 108 and the take-up dancer assembly 112 are mounted in different orientations on the central support wall 32. The take-up dancer assembly 112 is described herein with respect to FIG. 5, with the understanding that the supply dancer assembly 108 is identical in construction.

The take-up dancer assembly 112 includes a first loop cavity subassembly 144 which is mounted on a mounting plate 148, a second loop cavity subassembly 146 which is mounted on the mounting plate 148 and a dancing arm subassembly 145. The mounting plate 148 is mounted on the central support wall 32 by suitable means, such as screws.

The first loop cavity subassembly 144 includes a shallow, U-shaped channel 150 which is cantilevered relative to and secured to the mounting plate 148. The channel 150 is secured to the mounting plate 148 by suitable means, such as screws. The channel 150 is stiff so that minimum deflection occurs from the ribbon tension load as the ribbon passes through the take-up dancer arm assembly 112. An end plate 152 is attached to the free end of the channel 150 by suitable means, such as screws.

A first non-rotating shaft 174 is mounted in holes in the mounting plate 148 and in the end plate 152, such that the shaft 174 is aligned with and spaced from one end of the channel 150. A light-weight low idler roller 178 is mounted on the non-rotatable shaft 174 by a pair of ball bearings 180 such that the idler roller 178 is rotatable relative to the shaft 174, to a dancing arm 158 and to the channel 150.

A second non-rotating shaft 182 is mounted in holes in the mounting plate 148 and in the end plate 152, such that the shaft 182 is aligned with and spaced from the other end of the channel 150. A light-weight low idler roller 186 is mounted on the non-rotatable shaft 182 by a pair of ball bearings 188 such that the idler roller 186 is rotatable relative to the shaft 182, to the dancing arm 158 and to the channel 150.

The idler rollers 178, 186 have very low friction and are very thin so that they have low rotational inertia. The idler rollers 178, 186 are positioned proximate to, but spaced from, the ends of the dancing arm 158. The idler rollers 178, 186 are spaced from the ends of the dancing arm 158 the same distance.

The second loop cavity subassembly 146 includes a generally U-shaped channel 170 which is cantilevered relative to and secured to the mounting plate 148. The channel 170 is secured to the mounting plate 148 by suitable means, such as screws. The channel 170 is stiff so that minimum deflection occurs from the ribbon tension load as the ribbon passes through the take-up dancer arm assembly 112. An end plate 172 is attached to the free end of the channel 170 by suitable means, such as screws.

The dancing arm subassembly 145 includes the dancing arm 158 which is generally U-shaped and has one end thereof rotatably on a non-rotating shaft 154 by suitable fasteners 159. Because of the U-shape, the dancing arm 158 is in a folded configuration and does not have an extended length as is found in prior art dancing arms. The non-rotating shaft 154 is mounted in holes in the mounting plate 148 and in the end plate 172. The non-rotating shaft 154 is mounted at the midpoint of the channel 170 at a position which is spaced slightly above the ends of the channel 170. The dancing arm 158 is a lightweight aluminum sheet metal structure that is very stiff to minimize deflection when the unbalanced load from narrow ribbons is used and has low rotational inertia. A tab 161 is provided on the dancing arm 158 proximate to the connection point to the non-rotating shaft 154. The dancing arm 158 pivots on the shaft 154 and is capable of extending between the idler rollers 178, 186 as described herein. A dual or double-bodied torsion spring 166 is mounted on the non-rotatable shaft 154.

A light-weight non-rotatable shaft 160 is affixed to the other end, which is free, of the dancing arm 158. A light-weight low loop change roller 162 is mounted on the non-rotatable shaft 160 by a pair of ball bearings 164 such that the loop change roller 162 is rotatable relative to the shaft 160 and to the dancing arm 158.

From the centerpoint of the non-rotating shaft 154 to the centerpoint of the loop change roller 162, the distance is preferably 1.5 inches.

Figure 7:
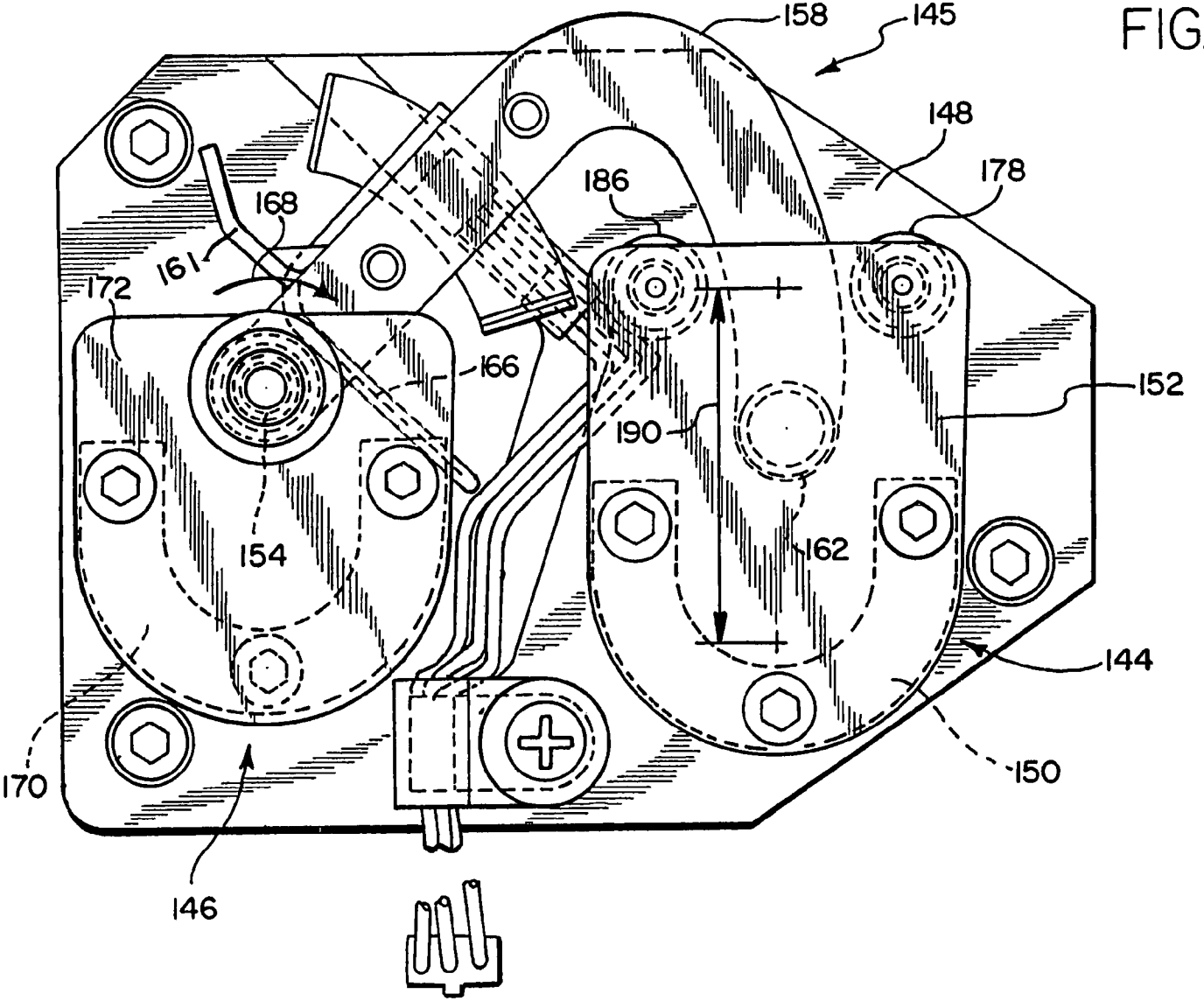
FIG. 7 is a side elevational view of the dancer assembly.

When assembled, the torsion spring 166 maintains a torque, indicated by arrow 168 in FIG. 7, that pressures the dancing arm 158 and the loop change roller 162 into the first loop cavity subassembly 144. That is, the dancing arm 158 and the loop change roller 162 extend between the idler rollers 178, 186 and toward the channel 150. The torsion spring 166 is designed to have a flat spring rate so that there is minimum ribbon tension change over the travel limits. The dancing arm 158 and the loop change roller 162 have minimum inertia when rotated about the shaft 154. The inertia of the dancing arm 158 when rotationally accelerated or decelerated during a start-up or stop ramp, a ramp being defined as a graph of velocity versus time, results directly in a ribbon tension variance. In addition, rotational friction is minimized because the inertia of the dancing arm 158 adds or subtracts from the ribbon tension depending on the direction of rotation of the dancing arm 158. The torsion spring 166 has sufficient torque and the inertia of the dancing arm 158 is sufficiently low to allow the torsion spring 166 to maintain pressure on the dancing arm 158 so that the dancing arm 158 maintains tension on the ribbon as the loop length of the ribbon increases.

FIG. 7 shows the travel limits of the dancing arm 158 within the first loop cavity subassembly 144 by distance 190. The spring loading of the dancing arm 158 supplies appropriate tension to the ribbon when the dancing arm 158 is within its travel limits. As shown in FIG. 7, the distance between the inner edges of idler rollers 178, 186 is slightly larger, approximately 0.032" larger, than the loop change roller 162. When the ribbon is loaded into the print and apply engine 20, the ribbon on one side of the loop change roller 162 is parallel to the ribbon the other side of the loop change roller 162 and this parallelism approximates a linear relationship of the dancing arm 158 which results in a "cosine" error. A close fit is required so that the ribbon strands are parallel and the "cosine" error that occurs between the ribbon and the loop change roller 162 on the dancing arm 158 is minimized as the dancing arm 158 moves throughout its travel limits. The location for the dancing arm pivot, on shaft 154, is on a line through the null (middle of travel) position of the dancing arm 158 and perpendicular to a line drawn through the travel limits of the dancing arm 158. This location of the pivot point provided by shaft 154 minimizes the "cosine" error that occurs due to the angular movement of the dancing arm 158. The longer the length of the dancing arm 158, the higher the inertia, however, the longer the length of the dancing arm 158, the smaller the "cosine" error.

As shown, the dancing arm 158 has a rotational length of approximately one and half inches.

Figure 5:
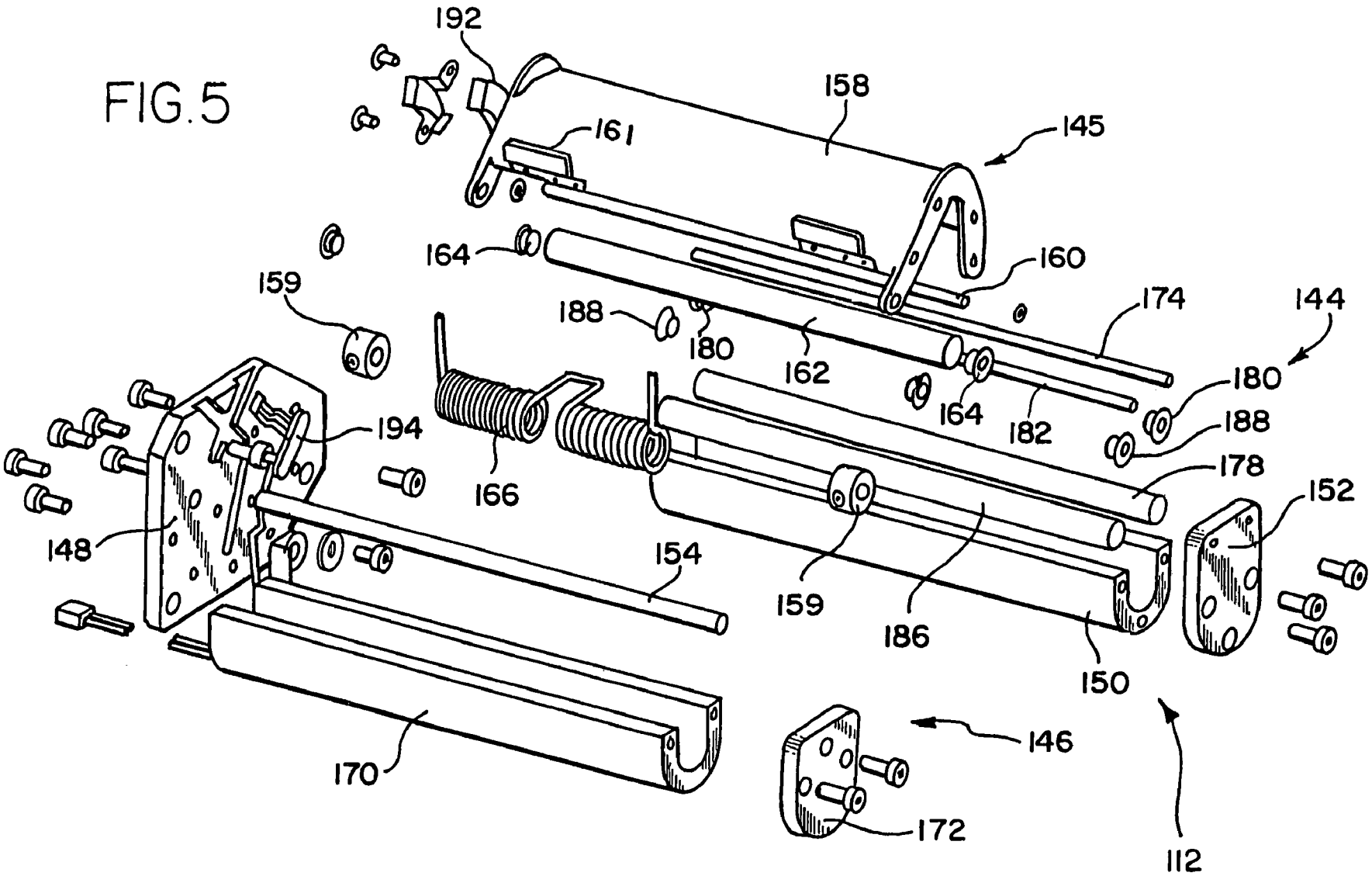
FIG. 5 an exploded perspective view of a dancer assembly.
Figure 6:
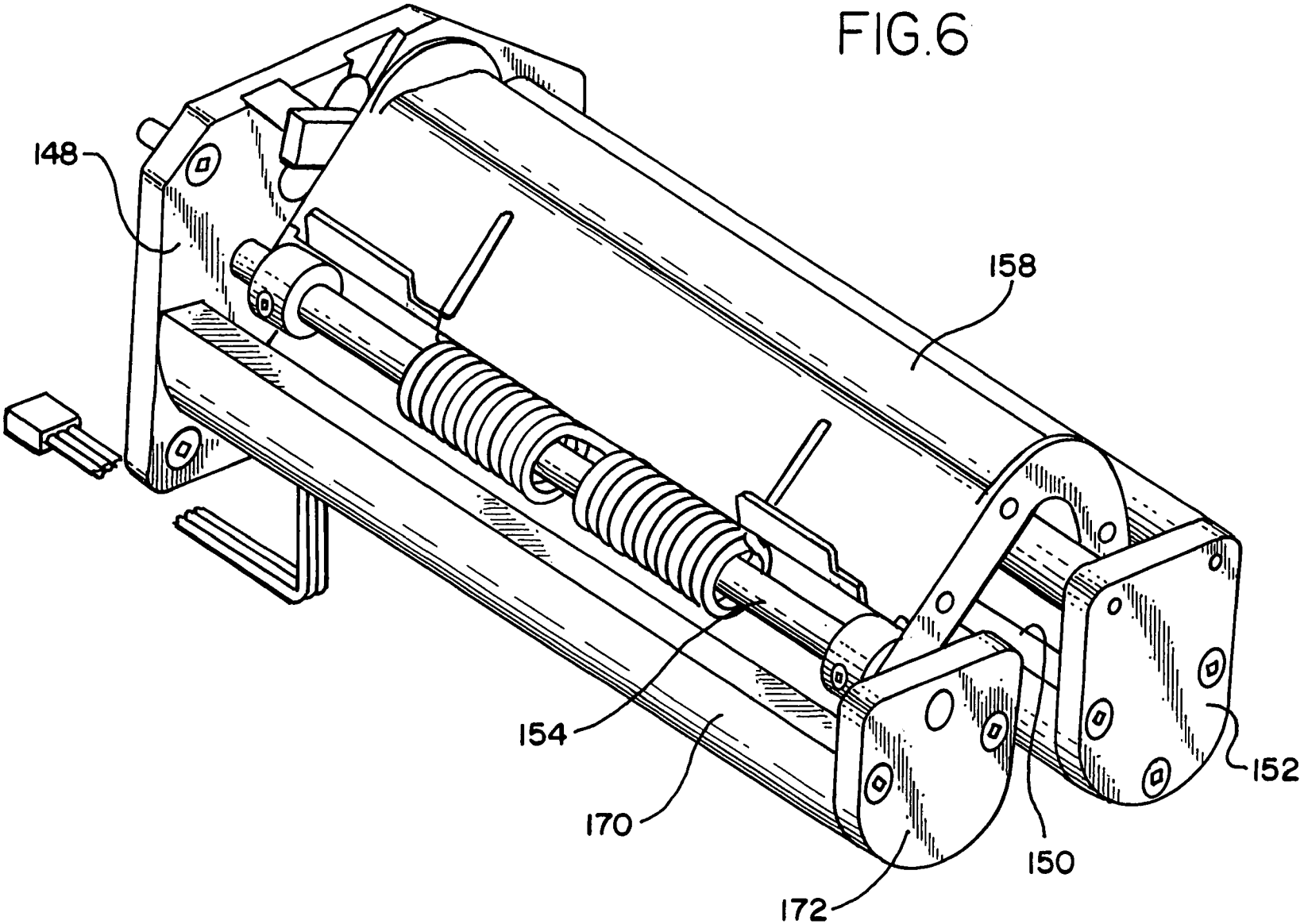
FIG. 6 is an assembled perspective view of the dancer assembly.

As shown in FIG. 5, a magnet 192 is attached to the end of the dancing arm 158 near the mounting plate 148. A position sensor 194, which is preferably a Hall effect sensor, a potentiometer, an optical type or an electric field type sensor, is mounted on the mounting plate 148. The magnet 192, in conjunction with the position sensor 194, provide a dancing arm position signal to suitable electronics of the central support wall 32. The electronics processes the position sensor output and supplies an appropriate signal to the DC torque motor 126. The electronics instruct the DC torque motor 126 to drive the ribbon spindle, in this case the ribbon take-up spindle 110, in the direction which is required to position the dancing arm 158 to its null position.

When the ribbon is not moving, the respective position sensors 194 instruct the respective DC torque motors 126 to rotate the ribbon supply spindle 106 and the ribbon take-up spindle 110 until the respective dancing arms 158 are in the null position where the print and apply engine 20 becomes stable.

The dancer assemblies 108, 112 are compact and enable a user to easily thread the ribbon through the print and apply engine 20. The spring loaded dancing arms 158 are lifted out of the associated channels 150 by pivoting the dancing arms 158 around the respective shafts 154. The tabs 161 on the dancing arms 158 enable a user to easily grasp the respective dancing arm 158 to pivot it away from the channel 150. The ribbon is passed from the ribbon supply spindle 106; through the supply dancer assembly 108 by passing between channels 150, 170, passing underneath idler roller 186, over loop change roller 162 and underneath idler roller 178; between printhead means and the platen roller 102; through the take-up dancer assembly 112 by passing the ribbon over idler roller 178, underneath loop change roller 162 and over idler roller 186 and exits between channels 150, 170. Thereafter, the dancing arms 158 are moved back into the associated channels 150 by pivoting the dancing arms 158 around the respective shafts 154. The folded configuration of the dancer assemblies 108, 112 prevent operator injury which can result if a long dancing arm is used as is provided in the prior art. In addition, the long dancing arms of the prior art can be easily bent out of shape thereby preventing proper operation of the print and apply engine 20. When the ribbon is loaded into the print and apply engine 20, the ribbon on one side of the loop change roller 162 is parallel to the ribbon the other side of the loop change roller 162. This parallelism approximates a linear relationship of the dancing arm 158 so that the geometry of different angles of the ribbon do not have to be taken into account for running the print and apply engine 20.

The dancing arm assemblies 108, 112 can accept ribbon widths in the range of one-half inch to four inches. The ribbon can be placed within the dancing arm assemblies 108, 112 at any position along the length of loop change roller 162.

In operation, when the platen roller 102 starts to rotate up to print speed at the designed ramp acceleration, the platen roller 102 pulls the ribbon from the supply side ribbon spindle 106. The guiding of the ribbon is performed by where the ribbon is placed on the loop change rollers 162.

The ribbon is threaded through the supply dancer assembly 108 by passing between channels 150, 170, passing underneath idler roller 186, over loop change roller 162 and underneath idler roller 178. As the ribbon passes underneath the idler roller 186, the idler roller 186 rotates relative to its shaft 182. As the ribbon passes over the loop change roller 162, the loop change roller 162 rotates relative to its shaft 160. As the ribbon passes underneath the idler roller 178, the idler roller 178 rotates relative to its shaft 174. The pulling motion from the platen roller 102 lifts the supply dancing arm 158 away from the channel 150. The idler rollers 178, 186 define a "pocket" for receiving the ribbon which the loop change roller 162 extends as the dancing arm 158 moves away from the channel 150.

When the supply dancing arm 158 moves, the associated position sensor 194 provides a signal to the electronics indicating that the supply dancing arm 158 is no longer at its null position. The electronics then provides a signal to an amplifier, which instructs a motor driver circuit to drive the supply DC torque motor 126. Because the supply dancing arm 158 is spring loaded by the torsion spring 166, the supply dancing arm 158 supplies appropriate tension to the ribbon when the supply dancing arm 158 is within its range of movement.

When the supply DC torque motor 126 is driven, the supply DC torque motor 126 rotates DC torque motor pinion gear, which, in turn, drives the two-stage intermediate gear 132. The two-stage intermediate gear 132 rotates on the non-rotatable shaft 136. The DC torque motor pinion gear drives the first gear 134 on the two-stage intermediate gear 132. The second gear 138 on the two-stage intermediate gear 132 drives the supply gear 114 which is part of the ribbon supply spindle 106. As the ribbon supply spindle 106 is rotated forward, this rotation supplies ribbon to the supply dancing arm 158 and lowers (moves the supply dancing arm 158 further into channel 150) the supply dancing arm 158 back to its null position.

The ribbon then passes between the printhead means and the platen roller 102. The ribbon is used to print on the media also passing between the printhead means and the positively-driven platen roller 102 in a conventional manner.

The platen roller 102 supplies ribbon to the take-up dancer assembly 112. The ribbon passes over idler roller 178, underneath loop change roller 162 and over idler roller 186 and exits between channels 150, 170. As the ribbon passes over idler roller 178, the idler roller 178 rotates relative to its shaft 174. As the ribbon passes underneath the loop change roller 162, the loop change roller 162 rotates relative to its shaft 160. As the ribbon passes over the idler roller 186, the idler roller 186 rotates relative to its shaft 182.

The take-up spindle 110 operates in reverse when compared to the supply spindle 106. Because the take-up dancing arm 158 is supplied ribbon from the platen roller 102, the take-up dancing arm 158 lowers. The idler rollers 178, 186 define a "pocket" for receiving the ribbon which the loop change roller 162 diminishes as the dancing arm 158 moves toward the channel 150. When the take-up dancing arm 158 moves, the associated position sensor 194 provides a signal to the electronics that the take-up dancing arm 158 is no longer at its null position. The electronics then provides a signal to the amplifier, which instructs a motor driver circuit to drive the supply DC torque motor 126. Because the take-up dancing arm 158 is spring loaded by the torsion spring 166, the take-up dancing arm 158 supplies appropriate tension to the ribbon when the take-up dancing arm 158 is within its range of movement.

When the take-up DC torque motor 126 is driven, the take-up DC torque motor 126 rotates DC torque motor pinion gear, which, in turn, drives the two-stage intermediate gear 132. The two-stage intermediate gear 132 rotates on the non-rotatable shaft 136. The DC torque motor pinion gear drives the first gear 134 on the two-stage intermediate gear 132. The second gear 138 on the two-stage intermediate gear 132 drives the take-up gear 116 which is part of the ribbon take-up spindle 110. This raises (moves the supply dancing arm 158 further out of the channel 150—supply dancing arm 158 does not exit the channel 150)) the take-up dancing arm 158 back to its null position. As such, the used ribbon is wound up on ribbon take-up spindle 110.

It is to be noted that if a user had a wide media and only wanted to print on a narrow section thereof, and if the user wanted to use a narrow width ribbon, which is less expensive than a wider width ribbon, collars or spacers can be placed upon the spindles 106, 110 between the ribbon and the supply gear 114, 116 and the print and apply engine 20 will function normally.

During a backfeed acceleration/deceleration cycle, the dynamic conditions of the dancing arms 158 are reversed.

With regard to the drive assemblies 118 which are used to drive the ribbon supply spindle 106 and the ribbon take-up spindle 110, several important criteria must be considered and followed. First, the torque and response time of the ribbon drive assemblies 118 must be sufficiently fast to speed the ribbon spindles 106, 110 up properly before the dancing arms 158 reach their limits of travel. Therefore, the faster the ramp time, the faster the drive assemblies 118 must be capable of reaching the proper speed. Second, each DC torque motor 126 must have sufficient torque to overcome the inertia of the wound ribbon, the inertia of the ribbon spindles 106, 110, the inertia and friction of the dancing arms 158, the inertia of the two-stage intermediate gears 132, and the inertia of its own armature and gears. The gear ratio is designed to maximize acceleration. Third, the supply spindle DC torque motor rotation forward is assisted by the torque created by the tension in the ribbon. The take-up spindle DC torque motor movement forward must overcome the tension of the ribbon as well as the inertia of its components. During a back feed, the ribbon tension load reverses. The ribbon tension load assists the take-up spindle 110 and adds load to the supply spindle 106.

With regard to the dancer arm assemblies 108, 112, several important criteria must be considered and followed. First, the dancing arms 158 must be stiff so that the dancing arms 158 will not twist when the ribbon is not full width. Twisting could loosen one side of the ribbon promoting ribbon wrinkle. Second, the dancing arms 158 must have very low inertia about their rotational axes. The rotational inertia of each dancing arm 158 multiplied by its angular acceleration creates a torque that results in an undesirable tension variance in the ribbon. Third, the rotational axis of each dancing arm 158 should be perpendicular to the path of the ribbon when the loop change roller 162 is at the null position. This centers the ribbon, thereby minimizing the "cosine" error that is created when the ribbon pull tension is not perpendicular to the dancing arm 158. The farther the loop change roller 162 is from the pivot point of the dancing arm 158 defined by shaft 154, the lower the cosine error, however, the farther the loop change roller 162 is from the pivot point of the dancing arm 158 defined by shaft 154, the higher the inertia. Fourth, the torsion springs 166 must provide torque equivalent to torque created by two ribbon tensions times its rotational length. Fifth, ribbon tension is a direct function of the torsion spring torque. Sixth, the torque of the torsion springs 166 must be sufficiently high to move the respective dancing arms 158 to keep tension in the ribbon as the loop length increases during an acceleration or deceleration ramp. Seventh, ideally the spring rate of the torsion springs 166 should be flat. The flatter the spring rate, the lower the ribbon tension variance between the top and bottom of the travel of each respective dancing arm 158. Eighth, the respective loop change rollers 162 must have low rotational friction. The loop change rollers 162 should be very thin so that the loop change rollers 162 have low rotational inertia both about their own respective axes and the respective dancing arm rotational axes. Ninth, the dancing arms 158 need to have minimum friction as they rotate. Any friction present adds to or subtracts from the desired ribbon tension.

The torsion spring 166 on the take-up dancing arm 158 can be designed to provide a higher tension on the ribbon than the torsion spring 166 on the supply dancing arm 158. This arrangement reduces smudging of the image on the label. Alternatively, the torsion springs 166 on each dancing arm 158 can be designed to provide equal ribbon tension and to have identical torque profiles so that the dancing arms 158 do not have to be adjusted.

With regard to the loop cavity subassembly 146 in the supply dancer assembly 108 and the take-up dancer assembly 112, several important criteria must be considered and followed. First, each loop cavity subassembly 146 needs to have sufficient stiffness to remain perpendicular to the central support wall 32 through all ribbon tension conditions. Second, the idler rollers 178, 186 must have very low friction and be very thin so that they have low rotational inertia. Third, the distance between the rollers 178, 186 need to be as close as possible to the diameter of the loop change roller 162 on the end of the respective dancing arm 158. The smaller the clearance between rollers 178, 186 and the loop change roller 162, the smaller the "cosine" error in ribbon tension that occurs as the dancing arms 158 travel through its range of travel.

With regard to the position sensor 194, several important criteria must be considered and followed. First, the position sensor 194 needs to be able to provide a signal that locates the position of the respective dancing arm 158 throughout its range of travel. Second, there are many types of applicable sensors other than the Hall Effect sensor, the potentiometer, the optical type or the electric field type sensor, other sensors can be used. The sensor must be capable of providing a signal proportional to the location of the respective dancing arm 158.

With regard to the amplifiers, each amplifier must have sufficient power and gain to drive the respective DC torque motor 126 so that the DC torque motor 126 responds sufficiently fast.

It is within the scope of the invention to provide structure for latching each dancing arm 158 in its fully open position to facilitate ribbon loading.

While a preferred embodiment of the present invention is shown and described, it is envisioned that those skilled in the art may devise various modifications of the present invention without departing from the spirit and scope of the appended claims.

The invention claimed is:

1. An apparatus for tensioning a medium comprising:

a supply assembly for supplying a medium;

a first dancer assembly for applying tension to the medium, said first dancer assembly being disposed downstream of said supply assembly, said first dancer assembly including a spring-biased first dancing arm and a first channel, a first portion of the first dancing arm being capable of moving in and out of the first channel;

a take-up assembly for taking up the medium, said take-up assembly disposed downstream of said first dancer assembly;

a housing on which said first dancer assembly is mounted; and a second dancer assembly for applying tension to the medium, said second dancer assembly including a spring-biased second dancing arm mounted on said housing.

2. An apparatus according to claim 1, further comprising a printhead disposed downstream of said first dancer assembly.

3. An apparatus according to claim 1, further comprising a second dancer assembly for applying tension to the medium, said second dancer assembly being positioned downstream of said first dancer assembly, said second dancer assembly including a spring-biased second dancing arm and a second channel, a portion of the second dancing arm being capable of moving in and out of the second channel.

4. An apparatus according to claim 1 further comprising a printhead disposed upstream of said first dancer assembly.

5. An apparatus according to claim 1, wherein said first dancer assembly comprises a first idler roller, and a second idler roller, wherein the first portion of the first dancing arm is capable of extending between the first idler roller and the second idler roller.

6. An apparatus according to claim 5, further comprising a third roller rotatably mounted on the first portion of the first dancing arm.

7. An apparatus according to claim 6, wherein the first idler roller, the third roller, and the second idler roller define a generally U-shaped path for the medium.

8. An apparatus according to claim 7, wherein a linear first portion of the U-shaped path is defined between the first idler roller and the third roller, wherein a linear second portion of the U-shaped path is defined between the third roller and the second idler roller, and wherein the first portion of the U-shaped path is approximately parallel to the second portion of the U-shaped path.

9. An apparatus according to claim 1 further comprising a position sensor operable to sense the disposition of the first dancing arm relative to the first channel.

10. An apparatus for tensioning a medium comprising:

a supply assembly for supplying a medium;

a dancer assembly for applying tension to the medium, said dancer assembly being disposed downstream of said supply assembly, said dancer assembly including a spring-biased dancing arm and a channel, a portion of the dancing arm being capable of moving in and out of the channel;

a take-up assembly for taking up the medium, said take-up assembly disposed downstream of said dancer assembly;

a position sensor operable to sense the disposition of the dancing arm relative to the channel; and a motor coupled to one of said supply assembly and said take-up assembly, wherein said motor, based on input from said position sensor, controls said supply assembly or said take-up assembly.

11. A tensioning apparatus for tensioning a medium in a printing system, the printing system defining a path for a medium to travel in a downstream direction, the tensioning apparatus disposed in the path, the tensioning apparatus comprising:

a housing;

a first idler roller rotatably attached to said housing;

a second idler roller rotatably attached to said housing, said second idler roller disposed downstream of said first idler roller; and a dancing arm comprising a proximal portion pivotally attached to said housing and a distal portion attached to the proximal portion, the distal portion movably disposed downstream of said first idler roller and upstream of said second idler roller such that a loop path for the medium is defined about the distal portion;

wherein the loop path has a path length between the first idler roller and the second idler roller;

wherein the proximal portion of said dancing arm is capable of pivoting toward said first roller and said second roller;

wherein the distal portion of said dancing arm moves when the proximal portion pivots toward said first roller and said second roller such the path length of the loop path increases.

12. A tensioning apparatus according to claim 11, wherein the loop path is a generally U-shaped path.

13. A tensioning apparatus according to claim 11, wherein the loop path is a generally V-shaped path.

14. A tensioning apparatus according to claim 11, wherein the loop path has a first linear portion between the first idler roller and the distal portion of said dancing arm, and wherein the loop path has second linear portion between the distal portion of said dancing arm and the second idler roller such that the first linear portion is parallel to the second linear portion.

15. A tensioning apparatus according to claim 14, wherein the first linear portion of the loop path has a first length, and wherein the second linear portion of the loop path has a second length that is approximately the same as the first length.

16. A tensioning apparatus according to claim 11, wherein the distal portion of the dancing arm is movably disposed between the first idler roller and the second idler roller.

17. A tensioning apparatus according to claim 11, said dancing arm further comprising a third roller rotatably mounted on the distal portion of said dancing arm.

18. A tensioning apparatus according to claim 17, wherein the third roller is approximately equidistant from the first idler roller and the second idler roller.

19. A tensioning apparatus according to claim 17, further comprising a medium having a first surface and a second surface opposing the first surface, the first surface contacting the first idler roller and the second idler roller, and the second surface contacting the third roller.

20. A printer defining a path for a medium to travel in a downstream direction, the printer comprising:

a supply assembly;

a medium extending from said supply assembly, said medium having a first surface and an opposing second surface; and a tensioning assembly downstream of said supply assembly, said tensioning assembly receiving said medium from said supply assembly, said tensioning assembly comprising a first idler roller contacting the first surface of said medium, a movable roller contacting the second surface of said medium downstream of the first idler roller, a second idler roller contacting the first surface of said medium downstream of the movable roller, and a generally U-shaped dancing arm on which the movable roller is rotatably mounted.

21. A printer according to claim 20, wherein the dancing arm comprises portions that are not co-linear with each other.

22. A printer according to claim 20, wherein the dancing arm comprises a first portion and a second portion, wherein the first portion is biased to pivot toward the first idler roller and the second idler roller, and wherein the second portion is attached to the first portion such that the second portion extends between the first idler roller and the second idler roller when the first portion pivots toward the first idler roller and the second idler roller.

23. A printer according to claim 22, said tensioning assembly further comprising a torsion spring biasing the first portion of the dancing arm to pivot toward the first idler roller and the second idler roller.

24. A printer according to claim 23, said tensioning assembly further comprising a shaft, wherein the dancing arm is pivotally mounted on the shaft, and wherein the torsion spring is mounted on the shaft.

25. A printer according to claim 20, wherein the dancing arm comprises a portion movably disposed between the first idler roller and the second idler roller, wherein the movable roller is rotatably mounted on the portion of the dancing arm.

26. A printer according to claim 20, said tensioning assembly further comprising a position sensor that senses the position of the dancing arm.

27. A printer according to claim 20, wherein the first idler roller, the second idler roller, and the movable roller are essentially parallel.

28. A printer according to claim 20, wherein a first linear portion of the medium is disposed between the first idler roller and the movable roller, and wherein a second linear portion of the medium is disposed between the movable roller and the second idler roller such that the first linear portion is essentially parallel to the second linear portion.

29. A printer according to claim 28, wherein the movable roller is approximately equidistant from the first idler roller and the second idler roller.

30. A printer according to claim 20, further comprising:

a head assembly disposed downstream of said tensioning assembly;

a second tensioning assembly disposed downstream of said head assembly, said second tensioning assembly comprising a first idler roller contacting said medium, a movable roller contacting said medium downstream of said first idler roller, and a second idler roller contacting said medium downstream of the movable roller.

31. A printer according to claim 30, wherein said head assembly comprises a printhead assembly.

* * * * *